United States Patent [19]

Akagi et al.

[11] 4,417,421

[45] Nov. 29, 1983

[54] APPARATUS FOR POLISHING INTERIOR SURFACES OF PIPES OR THE LIKE

[75] Inventors: Kazuo Akagi; Akihiro Fukuda; Tomio Saito, all of Shimonoseki, Japan

[73] Assignee: Kabushiki Kaisha Kobe Seiko Sho, Kobe, Japan

[21] Appl. No.: 307,673

[22] Filed: Oct. 1, 1981

[30] Foreign Application Priority Data

Aug. 28, 1981 [JP] Japan ..... 56-135854

[51] Int. Cl.[3] ..... B24C 3/16

[52] U.S. Cl. ..... 51/16; 51/411; 51/165.93; 51/281 P

[58] Field of Search ..... 51/281 P, 261, 16, 18, 51/22, 26, 411, 165.93

[56] References Cited

U.S. PATENT DOCUMENTS 2,497,021 2/1950 Sterns ..... 51/411

FOREIGN PATENT DOCUMENTS 336543 10/1930 United Kingdom ..... 51/16

751670 4/1956 United Kingdom ..... 51/411

*Primary Examiner*—Harold D. Whitehead

*Attorney, Agent, or Firm*—Oblon, Fisher, Spivak, McClelland & Maier

[57] ABSTRACT

A pipe polishing apparatus of the type in which a polisher rod is extractably inserted into a pipe to be polished and polishing grains are injected into a gap between the polisher rod and pipe while rotating the rod and pipe in opposite directions for polishing the interior surface of the pipe. The polisher rod has an outside diameter which is reduced stepwise or continuously in the polishing grain injecting direction to eliminate the localized abnormal abrasion of the polishing surface or the so-called "bell mouth phenomenon."

3 Claims, 7 Drawing Figures

APPARATUS FOR POLISHING INTERIOR SURFACES OF PIPES OR THE LIKE

BACKGROUND OF THE INVENTION

1. Field of the Invention

This invention relates to an apparatus for polishing interior surfaces of pipes, and more particularly to an apparatus for polishing inner surfaces of pipes of relatively small inside diameters.

2. Description of the Prior Art

It is known in the art to polish interior surfaces of a pipe which is horizontally supported on a support table and rotatably gripped at opposite ends thereof for rotation in one direction. An inner polisher rod which is inserted into the pipe throug one end thereof is rotated in a direction reverse to the pipe rotation direction, and polishing grains are injected into the gap between the inner surface of the pipe being treated and the polisher rod to polish the interior surfaces of the pipe.

FIG. 1 illustrates one example of such pipe polishing apparatus, supporting pipes 1 horizontally on a support table 2. Mounted on a movable frame 3 are grippers 4 which releasably grip one end of the pipes 1 and polishing grain injection pipes 5. Frames 3 are movable toward and away from the pipes 1 by operation of a transfer mechanism 6. A fixed support frame 7 which faces the other ends of the pipes 1 is provided with second grippers 8. When the movable support frame 3 is pressed against the pipes to be treated, opposite ends thereof are securely gripped in the respective grippers 4 and 8 to rotate the pipes 1 by a motor 9. Designated by 10 is a box for collecting the polishing grains. Inner polisher rods 11 are retractably inserted into the respective pipes 1 by a reciprocable feed mechanism 12 and rotated by a motor 13 in a direction opposite that of the pipe rotation.

During the polishing operation by the apparatus of this sort, it is often experienced that the pipe 1 undergoes excessive abrasion at the end opposite to the polishing grain injecting end (P) or at the polishing grain discharging end (Q) as indicated by reference number 14 in FIG. 2, which is generally referred to as "bell mouth." The bell mounth phenomenon usually occurs over about $\frac{1}{3}$ of the lengths of the treated pipes.

SUMMARY OF THE INVENTION

With the foregoing in view, the present invention has as its object the elimination of the bell mouth problem in the pipe polishing apparatus of the sort mentioned above.

According to the present invention, there is provided an apparatus for polishing interior surfaces of pipes or the like wherein a polisher rod is retractably inserted into a pipe to be treated and polishing grains are injected into a gap between the inner surface of the pipe and the polisher rod which are rotated in opposite directions, characterized in that the outside diameter of the polisher rod is reduced in the polishing grain injecting direction continuously or stepwise.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

In a pipe polishing machine as mentioned hereinbefore, the condition of the polished interior surface of a pipe is closely related with the shape of the polisher rod. FIGS. 3(A) to 3(E) illustrate the conditions of polished interior surfaces of pipes in relation with the shape of the polisher rod. In contrast to FIG. 3(A) usng a straight polisher rod with no diametral variations, FIGS. 3(B) to 3(E) shows the results of experiments by polisher rods with stepwise diametral variations along the lengths thereof.

In each experiment, a polishing rod of about 6 mm in diameter was inserted into a small-diameter pipe measuring about 12 mm in inside diameter and 4 m in length. In the polishing operation, the polisher rod and pipe were rotated in opposite directions while injecting polishing grains under a pressure of 2–4 kg/cm. The diameter of the polisher rod was reduced stepwise toward the polishing grain discharging end except in the experiment depicted in FIG. 3(A). It will be seen that in FIG. 3(A) the abrasion amounts to as much as 38 microns at the grain discharge end of the pipe against the abrasions of 6 and 8 microns at the grain injecting end and middle portion thereof, although the difference in abrasion is minimized by the use of the polisher rods with stepwise diametral variations.

The following table shows the abrasions at Position T close to polishing grain injecting end, Position M in the middle portion and Position B close to the polishing grain discharge end of the pipe in each one of the experiments depicted in FIGS. 3(A) to 3(E).

TABLE

| | Abrasion (μ) | | |
|---|---|---|---|
| Position | T | M | B |
| (A) | 6 | 8 | 38 |
| (B) | 6 | 10 | 15 |
| (C) | 10 | 8 | 10 |
| (D) | 12 | 12 | 16 |
| (E) | 15 | 15 | 15 |

Figure 1:
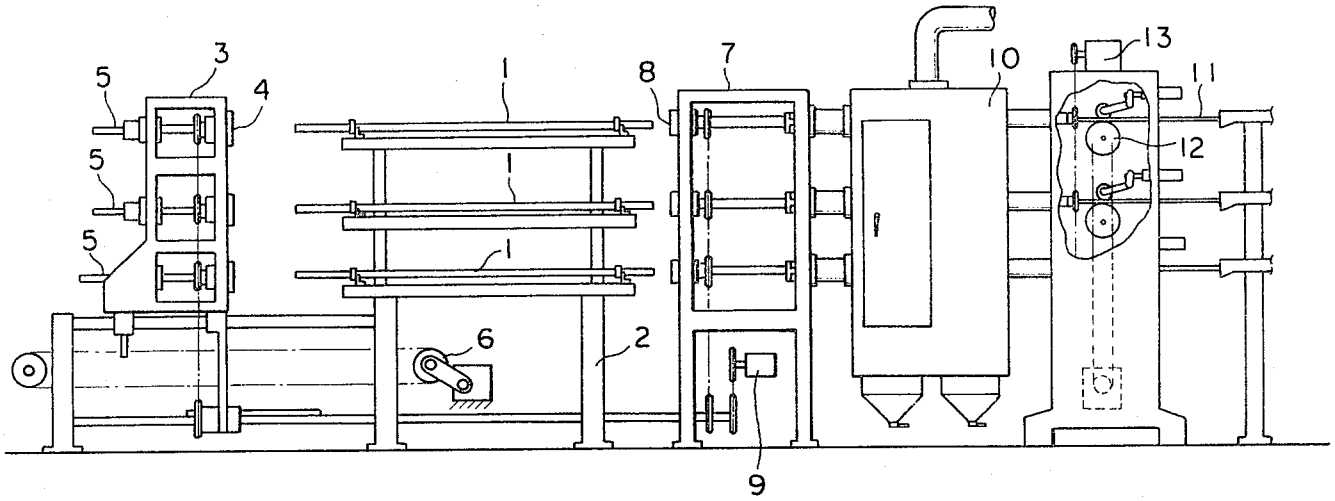
FIGURE 1 PRIOR ART
FIG. 1 is a side elevational view of an exemplary conventional pipe polishing machine.
Figure 2:
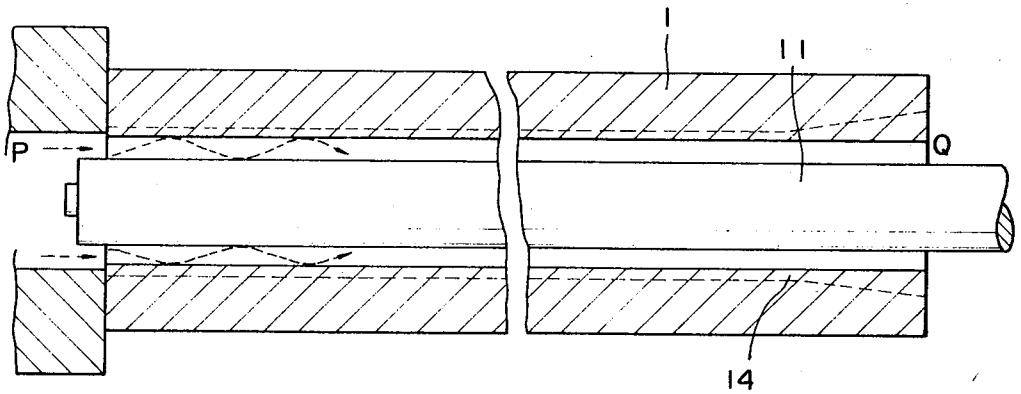
FIG. 2 is a schematic longitudinal sectional view of a pipe in the polishing operation.
Figure 3C:
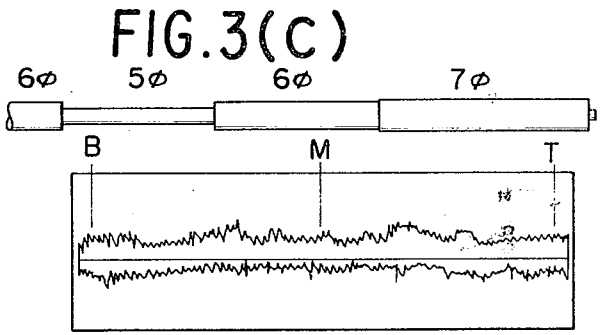
FIGS. 3(A) to 3(E) are diagrammatic views showing experimental data with regard to the shape of the polisher rod and the condition of the polished surface.
Figure 3D:
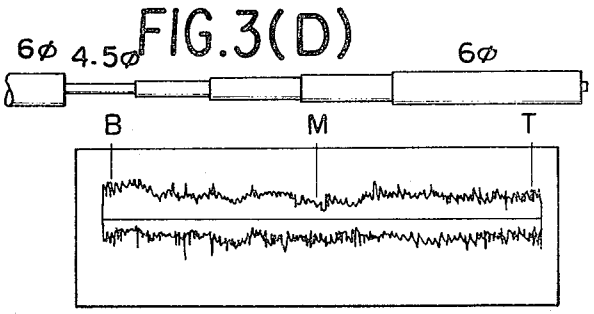
Figure 3E:
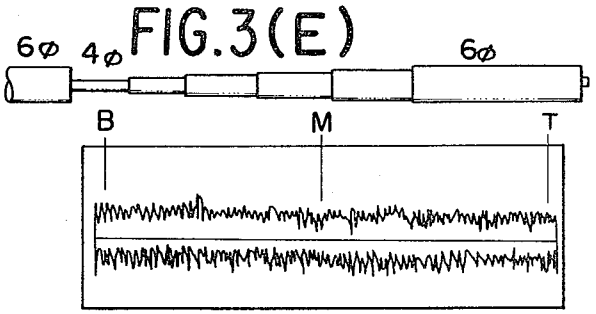
Figure 3A:
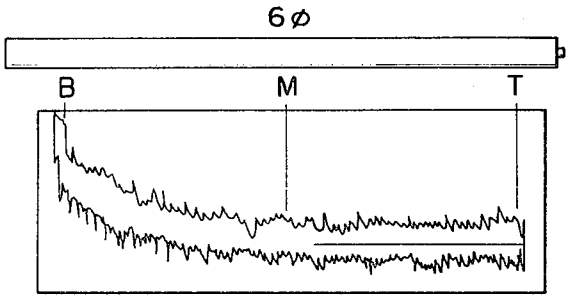
Figure 3B:
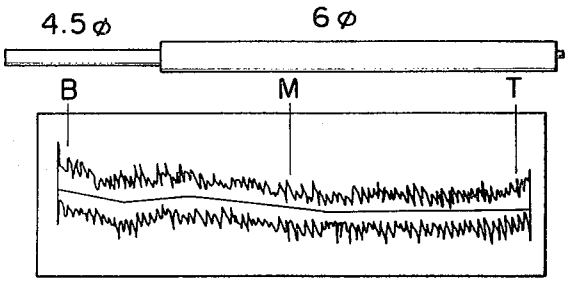

As seen in the foregoing table, the polisher rods of FIGS. 3(B) to 3(E) with stepwise diametral reductions serve to reduce the variations in abrasion along the length of the pipe, namely, to suppress the bell mouth phenomenon increasingly in that order, in contrast to the large variation caused by the 6 mmϕ straight polisher rod of FIG. 3(A). The bell mouth phenomenon is eliminated in the situation where the polisher rod has three or more stepwise diametral variations. However, even with a polisher rod having three sections of different diameters, the abrasion can be rendered uniform more by attaching dummy pipes to the opposite ends of the pipe in consideration of the yield of the product. The bell mouth can be further improved by providing the stepwise diametral variations at shorter intervals. If desired, the diameter of the polisher rod may be reduced continuously.

The polisher rod should have a diameter of about ½ of the inside diameter of the pipe to be polished with its diameter reduced toward its fore end at the polishing grain discharge end over a length corresponding to about 50–70% of the rod length so as to have finally a diameter of about ⅓ of the inside diameter of the pipe. That is to say, the minimum diameter at the fore end of the polisher rod is about 4 mmϕ for a pipe which has an inside diameter of 12 mmϕ.

Thus, according to the present invention employing a polishing rod of a diameter which is reduced stepwise or continuously in the direction of the polishing grain injecting direction, it has become possible to eliminate completely the bell mouth phenomenon or the localized abnormal increase in abrasion which occurs when inserting a polisher rod into a small-diameter pipe of about 12 mm in inside diameter and rotating the polisher rod and pipe in opposite directions while feeding a polishing fluid through one end of the pipe, due to the irregularly reflected polishing fluid and air which are discharged through the fore end of the pipe and the air pressure which is increased gradually by the internal resistance of the pipe during passage therethrough, accelerating the polishing speed at the pipe end away from the polishing fluid injection nozzle. Therefore, it is possible to remove the oxidation film from the interior surface of a pipe to provide a pipe with uniform and smooth polished surface free of variations in abrasion in the longitudinal direction of the pipe.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A pipe polishing apparatus comprising:

a polisher pipe extractably inserted into a pipe to be polished; and means for injecting polishing grains into a gap formed between the polisher rod and pipe and for simultaneously rotating the polisher rod and pipe in opposite directions to thereby polish the interior surface of said pipe, wherein said polisher rod has an outside diameter which is progressively reduced in the direction of polishing grain injection.

2. A pipe polishing apparatus as defined in claim 1, wherein said outside diameter of said polisher rod is reduced stepwise in the direction of polishing grain injecting.

3. A pipe polishing apparatus as defined in claim 1, wherein said outside diameter of said polisher rod is continuously reduced in the direction of polishing grain injecting.

* * * * *